US009650844B2

(12) United States Patent
Finke et al.

(10) Patent No.: US 9,650,844 B2
(45) Date of Patent: May 16, 2017

(54) BI-DIRECTIONAL CV-JOINT FOR A ROTARY STEERABLE SYSTEM

(71) Applicant: HALLIBURTON ENERGY SERVICES, INC., Houston, TX (US)

(72) Inventors: Michael Dewayne Finke, Cypress, TX (US); Daniel Winslow, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/890,454

(22) PCT Filed: Dec. 31, 2013

(86) PCT No.: PCT/US2013/078408
§ 371 (c)(1),
(2) Date: Nov. 11, 2015

(87) PCT Pub. No.: WO2015/102596
PCT Pub. Date: Jul. 9, 2015

(65) Prior Publication Data

US 2016/0084017 A1 Mar. 24, 2016

(51) Int. Cl.
*E21B 17/05* (2006.01)
*E21B 3/00* (2006.01)
(Continued)

(52) U.S. Cl.
CPC ..... *E21B 17/05* (2013.01); *E21B 3/00* (2013.01); *E21B 4/003* (2013.01); *E21B 7/04* (2013.01); *E21B 7/06* (2013.01); *E21B 17/03* (2013.01)

(58) Field of Classification Search
CPC ... E21B 17/05; E21B 3/00; E21B 7/06; E21B 7/04; E21B 4/003; E21B 17/03;
(Continued)

(56) References Cited

U.S. PATENT DOCUMENTS 4,391,547 A 7/1983 Jackson, Jr. et al.
4,904,228 A * 2/1990 Frear ..... E21B 17/05 464/152

(Continued)

FOREIGN PATENT DOCUMENTS

EP 0467335 A2 1/1992

OTHER PUBLICATIONS

International Search Report and Written Opinion issued in related PCT application No. PCT/US2013/78408, mailed on Sep. 25, 2014 (12 pages).

(Continued)

*Primary Examiner* — Michael Wills, III
(74) *Attorney, Agent, or Firm* — Alan Bryson; Baker Botts L.L.P.

(57) ABSTRACT

An example downhole apparatus includes a drive shaft with a longitudinal axis, a spherical portion that extends radially from the longitudinal axis, and first and second interfacial surfaces proximate the spherical portion. An outer housing is positioned at least partially around the spherical portion. A radial bearing may be between the spherical portion and the outer housing and coupled to the outer housing. The radial bearing may comprise first and second interfacial surfaces in contact with the respective first and second interfacial surfaces of the drive shaft to transmit or receive torque in corresponding first and second rotational directions. A first axial bearing is coupled to the outer housing and in contact with a first end of the spherical portion to axially secure the drive shaft with respect to the outer housing.

17 Claims, 4 Drawing Sheets

(51) Int. Cl.

| | |
|---|---|
| ***E21B 7/04*** | (2006.01) |
| ***E21B 17/03*** | (2006.01) |
| ***E21B 4/00*** | (2006.01) |
| ***E21B 7/06*** | (2006.01) |

(58) Field of Classification Search
CPC . E21B 7/068; E21B 7/067; F16D 3/10; F16D 3/16
USPC ..... 175/61; 464/140
See application file for complete search history.

(56) References Cited

U.S. PATENT DOCUMENTS

| | | | | |
|---|---|---|---|---|
| 5,205,789 | A | 4/1993 | Falgout, Sr. | |
| 5,669,455 | A | 9/1997 | Dietrich | |
| 5,706,905 | A | 1/1998 | Barr | |
| 5,875,859 | A | 3/1999 | Ikeda et al. | |
| 7,004,843 | B1 | 2/2006 | Kerstetter | |
| 8,033,917 | B2 * | 10/2011 | Prill | E21B 4/02 29/428 |
| 8,342,970 | B2 | 1/2013 | Altimas et al. | |
| 2002/0195278 | A1 | 12/2002 | Vandenberg et al. | |
| 2005/0098350 | A1 | 5/2005 | Eppink et al. | |
| 2006/0266555 | A1 | 11/2006 | Chen et al. | |
| 2009/0298597 | A1 * | 12/2009 | Wall | E21B 17/03 464/140 |
| 2011/0065518 | A1 * | 3/2011 | Patterson | F16D 3/18 464/139 |
| 2013/0056283 | A1 | 3/2013 | Wassell et al. | |
| 2013/0288810 | A1 * | 10/2013 | Foote | F16D 3/24 464/143 |

OTHER PUBLICATIONS

International Preliminary Report on Patentability issued in related Application No. PCT/US2013/078408, mailed Jul. 14, 2016 (6 pages).

* cited by examiner

BI-DIRECTIONAL CV-JOINT FOR A ROTARY STEERABLE SYSTEM

CROSS REFERENCE TO RELATED APPLICATION

The present application is a U.S. National Stage Application of International Application No. PCT/US 2013/078408 filed Dec. 31, 2013 which is incorporated herein by reference in its entirety for all purposes.

BACKGROUND

As well drilling operations become more complex, and hydrocarbon reservoirs correspondingly become more difficult to reach, the need to precisely locate a drilling assembly—both vertically and horizontally—in a formation increases. Part of this operation requires steering the drilling assembly, either to avoid particular formations or to intersect formations of interest. Steering the drilling assembly includes changing the direction in which the drilling assembly/drill bit is pointed, which may subject the steering to high axial, radial, and torsional loads. Certain downhole steering assemblies and other downhole tools transmit torque across an articulated joint that must accommodate the force loads.

FIGURES

Some specific exemplary embodiments of the disclosure may be understood by referring, in part, to the following description and the accompanying drawings.

Figure 1:
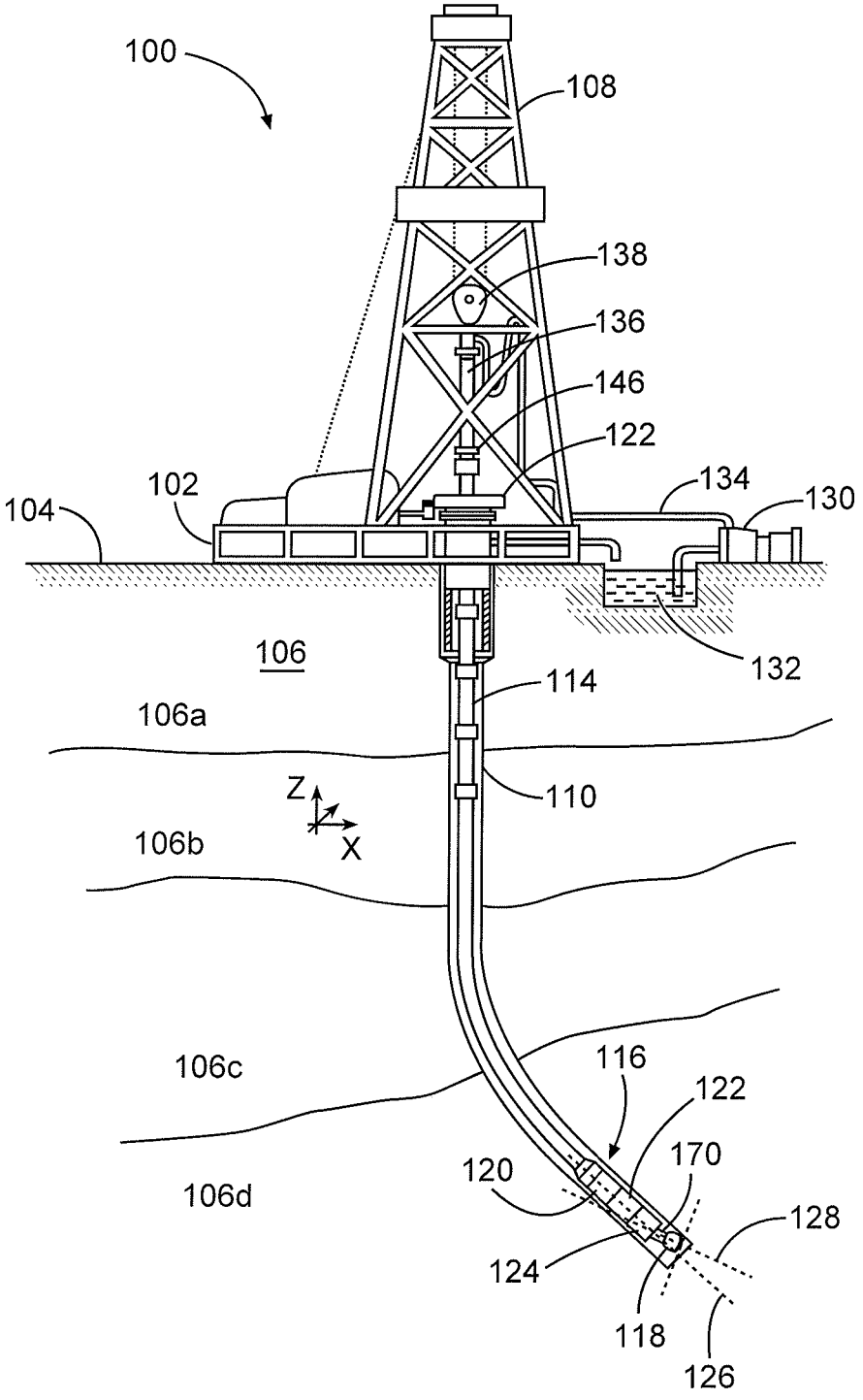
FIG. 1 is a diagram illustrating an example drilling system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like.

The terms "couple" or "couples" as used herein are intended to mean either an indirect or a direct connection. Thus, if a first device couples to a second device, that connection may be through a direct connection or through an indirect mechanical connection via other devices and connections.

Modern petroleum drilling and production operations demand information relating to parameters and conditions downhole. Several methods exist for downhole information collection, including logging-while-drilling ("LWD") and measurement-while-drilling ("MWD"). In LWD, data is typically collected during the drilling process, thereby avoiding any need to remove the drilling assembly to insert a wireline logging tool. LWD consequently allows the driller to make accurate real-time modifications or corrections to optimize performance while minimizing down time. MWD is the term for measuring conditions downhole concerning the movement and location of the drilling assembly while the drilling continues. LWD concentrates more on formation parameter measurement. While distinctions between MWD and LWD may exist, the terms MWD and LWD often are used interchangeably. For the purposes of this disclosure, the term LWD will be used with the understanding that this term encompasses both the collection of formation parameters and the collection of information relating to the movement and position of the drilling assembly.

FIG. 1 is a diagram of a subterranean drilling system 100, according to aspects of the present disclosure. The drilling system 100 comprises a drilling platform 102 positioned at the surface 104. In the embodiment shown, the surface 104 comprises the top of a formation 106 containing one or more rock strata or layers 106*a-d*, and the drilling platform 102 may be in contact with the surface 104. In other embodiments, such as in an off-shore drilling operation, the surface 104 may be separated from the drilling platform 102 by a volume of water.

The drilling system 100 comprises a derrick 108 supported by the drilling platform 102 and having a traveling block 138 for raising and lowering a drill string 114. A kelly 136 may support the drill string 114 as it is lowered through a rotary table 142 into a borehole 110. A pump 130 may circulate drilling fluid through a feed pipe 134 to kelly 136, downhole through the interior of drill string 114, through orifices in a drill bit 118, back to the surface via the annulus around drill string 114 and into a retention pit 132. The drilling fluid transports cuttings from the borehole 110 into the pit 132 and aids in maintaining integrity or the borehole 110.

The drilling system 100 may comprise a bottom hole assembly (BHA) 116 coupled to the drill string 114 near the drill bit 118. The BHA 116 may comprise a LWD/MWD tool 122 and a telemetry element 120. The LWD/MWD tool 122 may include receivers and/or transmitters (e.g., antennas capable of receiving and/or transmitting one or more electromagnetic signals). As the borehole 110 is extended through the formations 106, the LWD/MWD tool 122 may collect measurements relating to various formation properties as well as the tool orientation and position and various other drilling conditions. The telemetry sub 120 may transfer measurements from the LWD/MWD tool 122 to a surface receiver 146 and/or receive commands from the surface receiver 146.

The drill bit 118 may be driven by a downhole motor (not shown) and/or rotation of the drill string 110 to extend the borehole 110 through the formation 106. In certain embodiments, the downhole motor (not shown) may be incorporated into the BHA 116 directly above the drill bit 118 and may rotate the drill bit 118 using power provided by the flow of drilling fluid through the drill string 114. In embodiments where the drill bit 118 is driven by the rotation of the drill string 114, the rotary table 142 may impart torque and rotation to the drill string 114, which is then transmitted to the drill bit 118 by the drill string 114 and elements in the BHA 116.

In certain embodiments, the BHA 116 may further comprise a steering assembly 124. The steering assembly 124 may be coupled to the drill bit 118 and may control the drilling direction of the drilling system 100 by controlling the angle and orientation of the drill bit 118 with respect to the BHA 116 and/or the formation 106. The angle and orientation of the drill bit 118 may be controlled by the steering assembly 124, for example, by controlling a longitudinal axis 126 of the BHA 116 and a longitudinal axis 128 of the drill bit 118 together with respect to the formation 106 (i.e., a push-the-bit arrangement) or by controlling the longitudinal axis 128 of the drill bit 118 with respect to the longitudinal axis 126 of the BHA 116 (i.e., a point-the-bit arrangement.)

The steering assembly 124 may transmit torque across one or more articulated joints. In the embodiment shown, an articulated joint 170 may be within the steering assembly 124 and may function to alter the longitudinal axis 128 or the drill bit 118 with respect to the longitudinal axis 126 of the BHA 116 while transmitting rotation and torque from the drill string 114 to the drill bit 118. Torque may also be transmitted across articulated joints in other drilling system arrangements and tools, such as in the downhole mud motor described above. In certain embodiments, the articulated joint may comprise a constant-velocity (CV) join which may be incorporated into steering assembly 124 and other steering tools and downhole motors.

Figure 2:
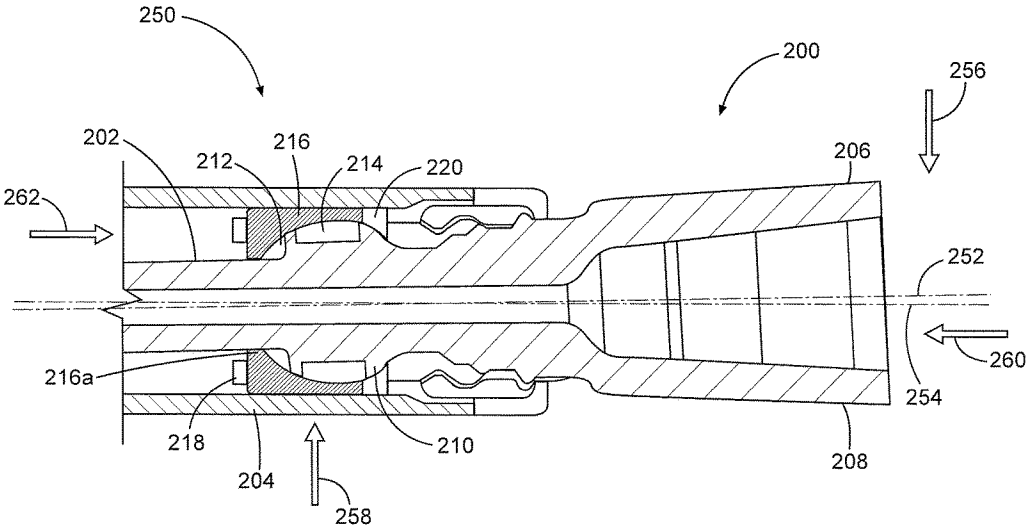
FIG. 2 is a diagram of an example steering assembly with an articulated joint, according to aspects of the present disclosure.

FIG. 2 is a diagram of an example steering assembly 200 with an articulated joint 250, according to aspects of the present disclosure. The steering assembly 200 comprises a drive shaft 202 at least partially within an outer housing or collar 204, which may be rotationally coupled to a drill string or the elements of a BHA coupled to the drill string (not shown). A bit sub 206 may be at an end of the drive shaft 202. The bit sub 206 may comprise a threaded inner surface 208 for connection with a drill bit (not shown). The bit sub 206 may be integrally formed with the drive shaft 202 or coupled to the drive shaft 202, such as through a threaded connection.

The articulated joint 250 comprises a spherical portion 210 of the drive shaft 202. Generally, the spherical portion 210 of the drive shaft 202 enables the shaft 202 to move around an indefinite number of axes having a common center, analogous to a ball and socket joint. The spherical portion 210 does not need to define a full sphere (i.e. it is a portion of a sphere). Additionally, the spherical portion does not need to be perfectly spherical in order to function as described herein, as manufacturing tolerances can be defined to provide an acceptable level of this functionality.

The spherical portion 210 may function as pivot point for the drive shaft 202 that facilitates modification of a longitudinal axis 252 of a drill bit coupled to the bit sub 206 for steering purposes. In the embodiment shown, the spherical portion 210 is positioned along the length of the drive shaft 202 and extends from the drive shaft 202 towards to the collar 204. Notably, the spherical portion 210 is not perfectly spherical, but may comprise one or more curved outer surfaces with a common radial dimensions from a reference point. The spherical portion 210 may be incomplete, or notched, as is shown with notched area 212.

In addition to functioning as a pivot point for the steering assembly 200, the spherical portion 210 may transmit torque and rotation from the collar 204 to the drive shaft 202.

In the embodiment shown, the drive shaft 202 comprises at least first and second interfacial surfaces 214 proximate the spherical portion 210 that may interact with respective at least first and second interfacial surfaces (not shown) coupled to the collar 204 to transfer torque between the drive shaft 202 and the collar 204, as will be described below. The interfacial surfaces 214 may comprise planar surfaces or any other type of surface that functions as a torque interface between the drive shaft 202 and the collar 204. The torque transferred from the collar 204 to the drive shaft 202 may in turn be transmitted to the bit sub 206 and a drill bit (not shown) coupled to the bit sub 206 to cause the drill bit to engage with and extend a borehole within a formation. The bit sub 206 will rotate about its longitudinal axis 252 and the longitudinal axis 254 of the collar 204. When the longitudinal axis 252 of the bit sub 206 is offset from the longitudinal axis 254 of the collar 204, which is the case when the steering assembly 200 is being steered in a particular direction, the steering assembly 200 may comprise a counter-rotating force or another mechanism that interacts with the drive shaft 202 to maintain the angular orientation of the bit sub 206. The drive shaft 202 may pivot about the articulated joint 250 while torque is being transmitted though the joint 250 to maintain the angular orientation of the bit sub 206.

The steering assembly 200 may be subject to one or more torsional, axial or radial forces that must be accommodated by the articulated joint 250 for the steering assembly 200 to function correctly. A radial force 256 may be imparted on the steering assembly 200 when a drill bit attached to the bit sub 206 contacts a side of a borehole in a steering operation. An opposite radial force 258 may be received at the articulated joint 250. Similarly, the steering assembly 200 may be subject to axial forces 260 and 262 due to the interaction with the bottom of a borehole and the weight of the drill string above the drilling assembly. These axial forces 260 and 262 also may be transmitted or absorbed through the articulated joint 250.

In certain embodiments, the articulated joint 250 may comprise one or more axial and radial bearings to absorb the axial and radial forces and increase the force capability of the articulated joint 250 and the steering assembly 200. In the embodiment shown, a radial bearing 216 may be at least partially positioned around the spherical portion 210 of the drive shaft 202 to at least partially absorb radial force 258 from the steering assembly. The radial bearing 216 may comprise a concave inner surface with similar dimensions to the spherical portion 210 of the drive shaft 202, allowing the spherical portion 210 of the drive shaft 202 to pivot smoothly. Specifically, the curvature of the radial bearing

216 may match the curvature of the spherical portion 210 to allow the spherical portion 210 to contact the radial bearing 216 and transmit radial force 258 without damaging the spherical portion 210 and to allow the drive shaft 202 to pivot at the articulated joint 250 without binding or becoming stuck.

The radial bearing 216 further may be coupled to the collar 204 and transmit rotation and torque from the collar 204 to the drive shaft 202. In certain embodiments, the radial bearing 216 may comprise at least first and second interfacial surfaces (not shown) that interact with the at least first and second interfacial surfaces 214 of the spherical portion 210 to transmit torque between the collar 204 and drive shaft 202. The radial bearing 216 may be integrally formed with the collar 204 or may be manufactured separately from and attached to the collar 204. In the embodiment shown, the radial bearing 216 comprises a cylindrical insert that is positioned within the collar 204 and coupled to the collar via bolts 218, although other connection mechanisms are possible.

The articulated joint 250 may further comprise an axial bearing 220 that absorbs axial forces in at least one axial direction. In the embodiment shown, the axial bearing 220 is coupled to the collar 204 and positioned at one axial end of the spherical portion 210 of the drive shaft 202 to absorb radial forces 262. The axial bearing 220 may comprise a concave inner surface that that is dimensionally similar to the spherical portion 210 of the drive shaft 202 and the radial bearing 216. Like the curvature of the radial bearing 216, the curvature of the axial bearing 220 may match the curvature of the spherical portion 210 to allow the spherical portion 210 to contact the axial bearing 220 and transmit axial force 262 without damaging the spherical portion 210 and to allow the drive shaft 202 to pivot at the articulated joint 250 without binding or becoming stuck.

In the embodiment shown, the radial bearing 216 includes a portion 216*a* that extends over the other axial end of the spherical portion 210 of the drive shaft 202 from the axial bearing 220. This portion 216*a* may absorb axial forces 260 and may also function to maintain the articulated joint 250 when axial force 262 is not applied to the drive shaft 202. Typical articulated joints may separate when downward axial forces are not applied. The radial bearing portion 216*a* may prevent that separation, allowing use of the steering assembly 200 in different axial force conditions. Although the axial support is provided by the radial bearing portion 216*a* in FIG. 2, a separate axial bearing may be used in other embodiments.

Figure 3:
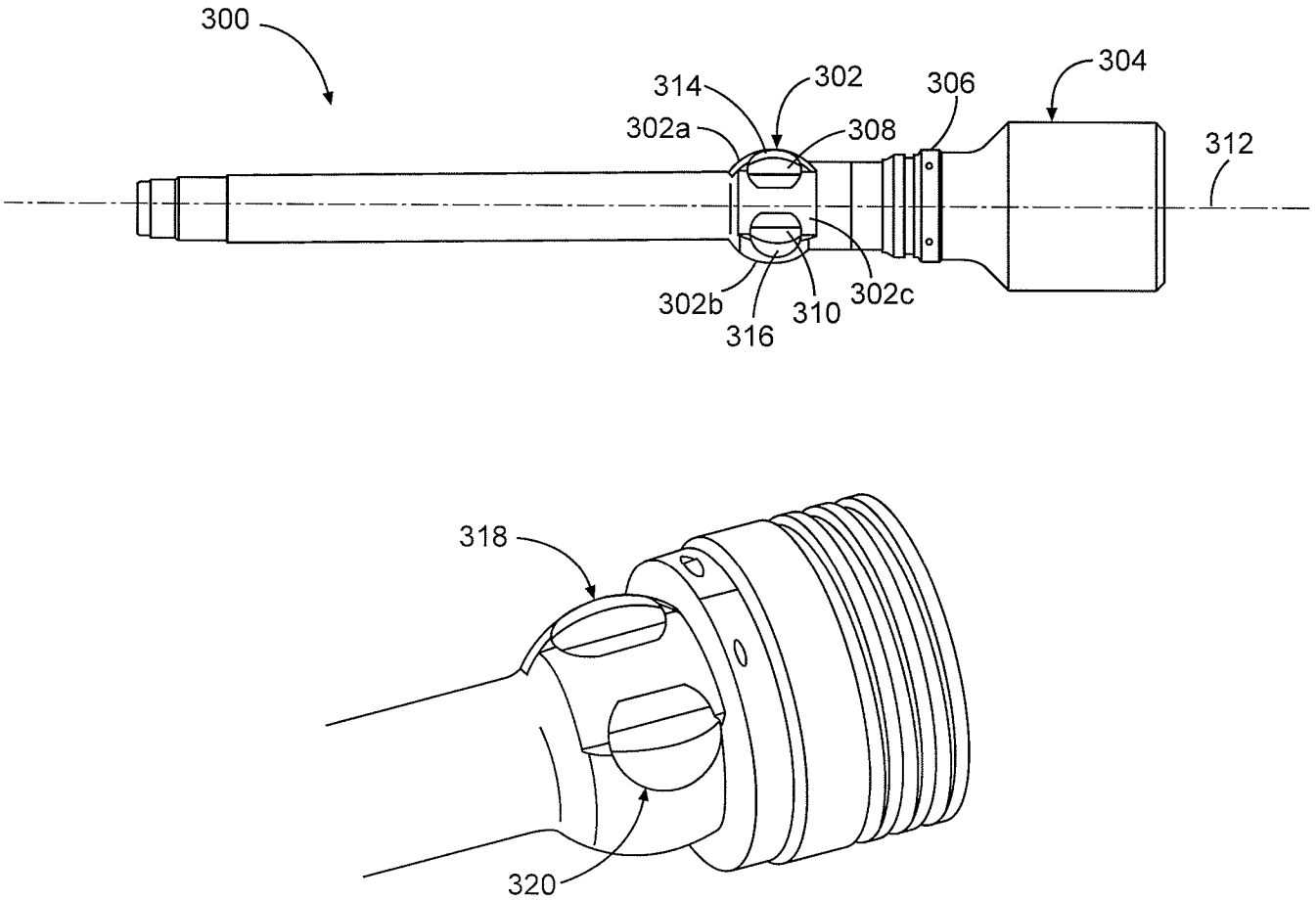
FIG. 3 is a diagram of an example drive shaft, according to aspects of the present disclosure.

FIG. 3 is a diagram of an example drive shaft, according to aspects of the present disclosure. As can be seen, the drive shaft 300 comprises a spherical portion 302 and is coupled directly to a bit sub 304 or coupled via threaded connection 306. In the embodiment shown, the spherical portion 302 comprises two spherical surfaces 302*a* and 302*b* separated by a cylindrical surface 302*c*. The drive shaft 300 may further comprise at least first and second interfacial surfaces proximate the spherical portion 302 that transmit/receive torque, with a first interfacial surface 308 oriented to transmit/receive torque and rotation in a first rotational direction and a second interfacial surface 310 oriented to transmit/receive torque and rotation in a second rotational direction opposite the first rotational direction. Specifically, the drive shaft 300 may rotate around an axis 312, and the first and second interfacial surfaces 308 and 310 may transmit/receive torque in both rotational directions with respect to the axis 312. Bi-directional torque transmission using the first and second interfacial surfaces 308 and 310 may avoid or limit torque conditions that may cause stress within and reduce the life of an articulated joint. One torque conditions is "shock loading," which occurs when the rotation/torque transmission in a first direction slows or stops and then starts again abruptly. Shock loading is exacerbated when there is a gap or backlash between rotational loading in a first and second direction. By including a second interfacial surface for minimizing backlash and for torque transfer in an opposite direction, the torque transmissions are smoother and the stress on the articulated joint is lessened.

In the embodiment shown, the first and second interfacial surfaces 308 and 310 comprise sides of oscillating disks 314 and 316, respectively. The disks 314 and 316 may have spherical top surfaces that are dimensionally similar to the spherical portion 302 and may oscillate about an axis that is perpendicular to the axis 312 of the drive shaft 300. The disks 314 and 316 may be manufactured separately from the drive shaft 300, and rotatably coupled to the drive shaft 300 at cylindrical surface 318 and 320, respectively, which may facilitate oscillation of the disks 314 and 316. The oscillation of the disks 314 and 316 may ensure that the entire first and second interfacial surfaces 308 and 310 of the disks 314 and 316 remain in full contact with corresponding first and second interfacial surfaces of an articulated joint to transmit/receive the full torque load even when the drive shaft 302 is pivoting at the joint. With respect to a steering assembly similar to the one described in FIG. 2 that incorporates the drive shaft 300, as the longitudinal axis 312 of the drive shaft 300 is altered with respect to an outer housing, the first and second interfacial surfaces 308 and 310 of the disks 314 and 316 may remain in a substantially unchanged position with respect to the outer housing and interfacial surfaces coupled to the outer housing that transmit torque to the drive shaft 300.

Figure 4:
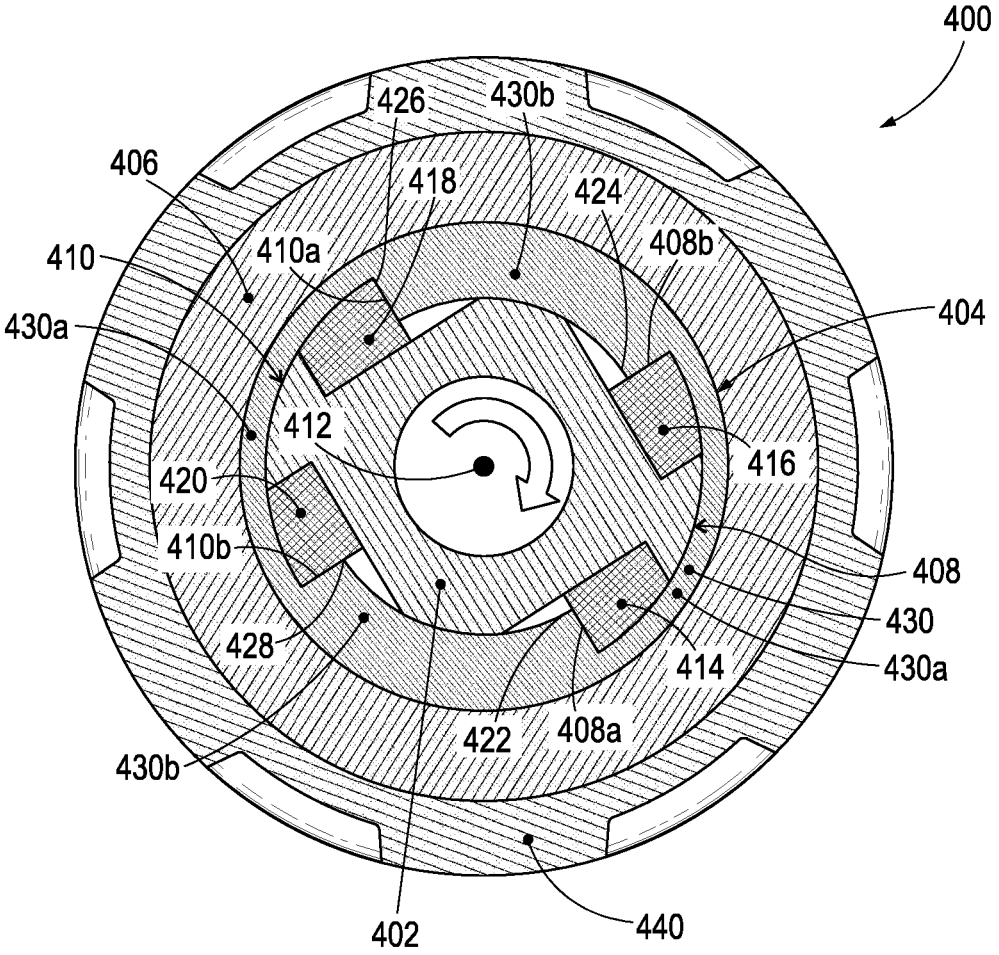
FIG. 4 is a diagram of an example articulated joint, according to aspects of the present disclosure.

FIG. 4 is a diagram of an example articulated joint 400, according to aspects of the present disclosure. Specifically, FIG. 4 illustrates a cross section of an example steering assembly comprising the articulated joint and a drive shaft 402 with a spherical portion 404 similar to those described above. The drive shaft 402 is positioned within an outer housing or collar 406, which may be coupled to a drill string (not shown) that transmits torque and rotation from a surface location to the collar 406. In certain embodiments, the drive shaft 402 may be coupled to a bit sub (not shown) and may transmit torque from the collar 406 to the bit sub.

The drive shaft 402 comprises spherical portions 408 and 410, which extend from the axis 412 of the drive shaft 402 in a radial direction. Each of the spherical portions 408 and 410 comprise two interfacial surfaces, 408*a* and 408*b* and 410*a* and 410*b*, respectively. The interfacial surfaces may be positioned on planes that intersect with the axis 412 of the drive shaft. In the embodiment shown, each of the interfacial surfaces 408*a*, 408*b*, 410*a*, and 410*b* are surfaces of a different oscillating disk 414-420, respectively. As can be seen, the oscillating disks 414-420 have an outer surface that forms a constant circumferential surface with the remainder of the spherical portions 408 and 410. Additionally, as described above, the oscillating disks 414-420 are coupled to the drive shaft 402 at substantially flat areas with cylindrical walls or pockets that allow the oscillating disks 414-420 to move freely.

The articulated joint 400 may further comprise at least one interfacial surface that contacts at least one interfacial surface of the drive shaft 402 to transfer torque between the collar 406 and the drive shaft 402. In the embodiment shown, the articulated joint 400 comprises four interfacial surfaces 422-428, each oriented similarly and corresponding to the interfacial surfaces 408*a*, 408*b*, 410*a*, and 410*b* of the drive shaft 402. The contact points between the interfacial surfaces may comprise torque transfer surfaces which function as the primary area for torque transmission across the joint 400. In particular, the driveshaft 402 may comprise at least one first interfacial surface 410*a* and 408*a* that contacts at least one first interfacial surface 426 and 422 of a radial bearing 430 coupled to the collar 406 to transmit or receive torque in the first rotational direction. Similarly, the driveshaft 402 may comprise at least one second interfacial surface 410*b* and 408*b* that contacts at least one second interfacial surface 428 and 424 of the radial bearing 430 to transmit or receive torque in the second rotational direction, opposite the first direction. As described above, the interfacial surfaces are positioned to transmit torque in both rotational directions within respect to the axis 412, to reduce shock loading and other potentially harmful torque conditions.

The articulated joint 400 further comprises the radial bearing 430, positioned between the collar 406 and the drive shaft 402. As described above, the radial bearing 430 may absorb radial loads encountered by the drive shaft 402 during steering operations. In the embodiment shown, the radial bearing 430 comprises two segments, an outer tubular segment 430*a* and an inner segment 430*b* on which the interfacial surface interfacial surfaces 422-428 are integrally formed. The first tubular segment 430*a* may be used primarily to increase the force capability of the articulated joint 400, while the inner segment 430*b* may be used primarily to transmit torque to/from the drive shaft 402. The outer tubular segment 430*a* and inner segment 430*b* may be manufactured separately and coupled together, or may be formed integrally. A stabilizer 440 may be positioned on the outside of the outer housing 406 and may be used to react radial loads with the wellbore.

An example downhole apparatus includes a drive shaft with a longitudinal axis, a spherical portion that extends radially from the longitudinal axis, and first and second interfacial surfaces proximate the spherical portion. An outer housing is positioned at least partially around the spherical portion. A radial bearing may be between the spherical portion and the outer housing and coupled to the outer housing. The radial bearing may comprise first and second interfacial surfaces in contact with the respective first and second interfacial surfaces of the drive shaft to transmit or receive torque in corresponding first and second rotational directions. A first axial bearing is coupled to the outer housing and in contact with a first end of the spherical portion to axially secure the drive shaft with respect to the outer housing.

The first interfacial surface of the drive shaft is positioned on a first oscillating disk coupled to the drive shaft and the second interfacial surface of the drive shaft is positioned on a second oscillating disks coupled to the drive shaft. The first interfacial surface of the drive shaft may be positioned on a plane perpendicular to the longitudinal axis. In certain embodiments, the radial bearing may comprise a spherical inner surface that is dimensionally similar to the spherical portion. The first and second interfacial surfaces of the drive shaft may be integrally formed on the radial bearing, and the radial bearing may comprise a portion that contacts a second end of the spherical portion opposite the first end to axially secure the drive shaft with respect to the outer housing.

In certain embodiments, a second axial bearing may be coupled to the outer housing and in contact with a second end of the spherical portion opposite the first end to axially secure the drive shaft with respect to the outer housing. At least one of the first axial bearing and the second axial bearing may comprise a spherical inner surface that is dimensionally similar to the spherical portion. At least one of the radial bearing and the first axial bearing may be integrally formed with the outer housing. And the drive shaft may comprise a portion of a downhole motor or a steering assembly.

According to aspects of the present disclosure, a steering assembly for subterranean drilling operations may include an outer collar coupled to a drill string and a drive shaft at least partially within the outer collar. A drill bit may be coupled to the drive shaft, and a constant velocity (CV) joint may transmit torque to the drive shaft from the outer collar and allow a longitudinal axis of the drill bit to be changed with respect to the outer collar. The CV joint may comprise a spherical portion of the drive shaft that extends radially from the drive shaft and first and second interfacial surfaces proximate the spherical portion, and a radial bearing may be coupled to the outer collar. The radial bearing may comprise first and second interfacial surfaces in contact with the respective first and second interfacial surfaces of the drive shaft to transmit or receive torque in corresponding first and second rotational directions. A first axial bearing may be coupled to the outer housing and in contact with a first end of the spherical portion, and a second axial bearing may be coupled to the outer housing and in contact with a second end of the spherical portion opposite the first end.

A drill bit may be coupled to the drive shaft. The first interfacial surface of the drive shaft may be positioned on a first oscillating disk coupled to the drive shaft and the second interfacial surface of the drive shaft may be positioned on a second oscillating disks coupled to the drive shaft. In certain embodiments, one of the first and second axial bearings may comprise a portion of the radial bearing. The radial bearing may comprise an insert with a spherical inner surface that is dimensionally similar to the spherical portion.

An example method for subterranean drilling operations may comprise positioning an outer housing and a drive shaft within a borehole, with the drive shaft comprising a spherical portion at least partially within the outer housing and first and second interfacial surfaces proximate the spherical portion. Torque may be transmitted between the outer housing and the drive shaft using a radial bearing coupled to the outer housing in at least one of a first rotational direction using the first interfacial surface of the drive shaft and a first interfacial surface of the radial bearing, and a second rotational direction opposite the first rotational direction using the second interfacial surface of the drive shaft and a second interfacial surface of the radial bearing. The method may also include receiving at least one of a first axial force at a first axial bearing coupled to the outer housing and in contact with a first end of the spherical portion, and a radial force at the radial bearing.

In certain embodiments, the first interfacial surface of the drive shaft is positioned on a first oscillating disk coupled to the drive shaft and the second interfacial surface of the drive shaft is positioned on a second oscillating disks coupled to the drive shaft. The first and second interfacial surfaces of the radial bearing may be positioned on an inner surface of the radial bearing. In certain embodiments, the method may include receiving a second axial force at a second axial bearing coupled to the outer housing and in contact with a second end of the spherical portion opposite the first end. The second axial bearing may comprise a portion of the radial bearing.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces. Additionally, the terms "couple" or "coupled" or any common variation as used in the detailed description or claims are not intended to be limited to a direct coupling. Rather two elements may be coupled indirectly and still be considered coupled within the scope of the detailed description and claims.

What is claimed is:

1. A downhole apparatus for drilling operations, comprising:

a drive shaft with a longitudinal axis, a spherical portion extending radially from the longitudinal axis, and first and second interfacial surfaces proximate the spherical portion;

an outer housing at least partially around the spherical portion;

a radial bearing coupled to the outer housing between the spherical portion and the outer housing and comprising first and second interfacial surfaces in contact with the respective first and second interfacial surfaces of the drive shaft to transmit or receive torque in corresponding first and second rotational directions, wherein the first interfacial surface of the drive shaft is positioned on a first oscillating disk coupled to the drive shaft, and the second interfacial surface of the drive shaft is positioned on a second oscillating disk coupled to the drive shaft; and a first axial bearing coupled to the outer housing and in contact with a first end of the spherical portion to axially secure the drive shaft with respect to the outer housing.

2. The apparatus of claim 1, wherein the first international surface of the drive shaft is positioned on a plane to the longitudinal axis.

3. The apparatus of claim 1, wherein the radial bearing comprises a spherical inner surface dimensionally similar to the spherical portion.

4. The apparatus of claim 3, wherein the first and second interfacial surfaces of the radial bearing are integrally formed on the radial bearing.

5. The apparatus of claim 3, wherein the radial bearing comprises a portion contacting a second end of the spherical portion opposite the first end to axially secure the drive shaft with respect to the outer housing.

6. The apparatus of claim 1, further comprising a second axial bearing coupled to the outer housing and in contact with a second end of the spherical portion opposite the first end to axially secure the drive shaft with respect to the outer housing.

7. The apparatus of claim 6, wherein at least one of the first axial bearing and the second axial bearing comprises a spherical inner surface that is dimensionally similar to the spherical portion.

8. The apparatus of claim 1, wherein at least one of the radial bearing and the first axial bearing is integrally formed with the outer housing.

9. The apparatus of claim 1, wherein the drive shaft comprises a portion of a downhole motor or a steering assembly.

10. A steering assembly for subterranean drilling operations, comprising an outer collar coupled to a drill string;

a drive shaft at least partially within the outer collar;

a drill bit coupled to the drive shaft; and a constant velocity (CV) joint that transmits torque to the drive shaft from the outer collar and allows a longitudinal axis of the drill bit to be changed with respect to the outer collar, the CV joint comprising a spherical portion that extends radially from the drive shaft and first and second interfacial surfaces proximate to the spherical portion;

a radial bearing coupled to the outer housing between the spherical portion and the outer housing and comprising first and second interfacial surfaces in contact with the respective first and second interfacial surfaces of the drive shaft to transmit or receive torque in corresponding first and second rotational directions, wherein the first interfacial surface of the drive shaft is positioned on a first oscillating disk coupled to the drive shaft, and the second interfacial surface of the drive shaft is positioned on a second oscillating disk coupled to the drive shaft;

a first axial bearing coupled to the outer housing and in contact with a first end of the spherical portion; and a second axial bearing coupled to the outer housing and in contact with a second end of the spherical portion opposite the first end.

11. The steering assembly of claim 10, further comprising a drill bit coupled to the drive shaft.

12. The steering assembly of claim 10, wherein one of the first and second axial bearings comprises a portion of the radial bearing.

13. The steering assembly of claim 10, wherein the radial bearing comprises an insert with a spherical inner surface that is dimensionally similar to the spherical portion.

14. A method for subterranean drilling operations, comprising positioning an outer housing and a drive shaft within a borehole, the drive shaft comprising a spherical portion at least partially within the outer housing and first and second interfacial surfaces proximate the spherical portion;

transmitting torque between the outer housing and the drive shaft through a radial bearing coupled to the outer housing, the torque transmitted in at least one of a first rotational direction using the first interfacial surface of the spherical portion and a first interfacial surface of the radial bearing; and a second rotational direction opposite the first rotational direction using the second interfacial surface of the spherical portion and a second interfacial surface of the radial bearing, wherein the first interfacial surface of the drive shaft is positioned on a first oscillating disk coupled to the drive shaft, and the second interfacial surface of the drive shaft is positioned on a second oscillating disk coupled to the drive shaft; and receiving at least one of a first axial force at a first axial bearing coupled to the outer housing and in contact with a first end of the spherical portion; and a radial force at the radial bearing.

15. The method of claim 14, wherein the first and second interfacial surfaces of the radial bearing are positioned on an inner surface of the radial bearing.

16. The method of claim 14, further comprising receiving a second axial force at a second axial bearing coupled to the outer housing and in contact with a second end of the spherical portion opposite the first end.

17. The method of claim 16, wherein the second axial bearing comprises a portion of the radial bearing.

* * * * *